US010662728B2

(12) United States Patent
Hajji et al.

(10) Patent No.: US 10,662,728 B2
(45) Date of Patent: May 26, 2020

(54) METHOD AND APPARATUS FOR STUCK PIPE MITIGATION

(71) Applicant: Saudi Arabian Oil Company, Dhahran (SA)

(72) Inventors: Ali Hajji, Dhahran (SA); Ossama Ramzi Mahmoud Sehsah, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 191 days.

(21) Appl. No.: 16/030,011

(22) Filed: Jul. 9, 2018

(65) Prior Publication Data

US 2020/0011156 A1 Jan. 9, 2020

(51) Int. Cl.

| | |
|---|---|
| ***E21B 31/03*** | (2006.01) |
| ***E21B 27/02*** | (2006.01) |
| ***E21B 31/00*** | (2006.01) |

(52) U.S. Cl.

CPC ..... *E21B 31/03* (2013.01); *E21B 27/02* (2013.01); *E21B 31/00* (2013.01)

(58) Field of Classification Search

CPC ..... E21B 34/16; E21B 34/14; E21B 31/00; E21B 31/03; E21B 27/02; E21B 27/00

See application file for complete search history.

(56) References Cited

U.S. PATENT DOCUMENTS

| | | | |
|---|---|---|---|
| 2,894,585 | A | 9/1954 | Erwin |
| 4,279,304 | A | 7/1981 | Harper |
| 4,361,193 | A | 11/1982 | Gravley |
| 4,427,564 | A | 1/1984 | Brownawell et al. |
| 6,148,917 | A | 11/2000 | Brookey et al. |
| 6,267,186 | B1 | 7/2001 | Hayatdavoudi |
| 6,435,276 | B1 | 8/2002 | Kercheville et al. |
| 8,048,828 | B2 | 11/2011 | Deville |

(Continued)

FOREIGN PATENT DOCUMENTS

| | | | |
|---|---|---|---|
| EP | 0200466 | A2 | 11/1985 |
| WO | 2017131859 | A1 | 8/2017 |

OTHER PUBLICATIONS

International Search Report and Written Opinion for related PCT application PCT/US2019/040973 dated Oct. 16, 2019.

*Primary Examiner* — Michael R Wills, III

(74) *Attorney, Agent, or Firm* — Bracewell LLP; Constance G. Rhebergen; Linda L. Morgan

(57) ABSTRACT

Systems and methods for moving a tubular string within a subterranean well include a collar tool assembly that has a tubular body. The tubular body has an inner bore that is in fluid communication with an inner bore of the tubular string. An outer cavity is located radially outward of the inner bore. An injection port assembly extends from the outer cavity to an outer diameter surface of the tubular body and can move between an injection port closed position and an injection port open position. A hydraulic system can force a treatment fluid of the outer cavity out of the tubular body when the injection port is in the injection port open position. An injection port programmable logic controller is in signal communication with the hydraulic system and can command the injection port assembly to move between the injection port closed position and the injection port open position.

16 Claims, 2 Drawing Sheets

(56) References Cited

U.S. PATENT DOCUMENTS

| | | | | |
|---|---|---|---|---|
| 8,162,055 | B2 * | 4/2012 | Lewis | E21B 27/02 166/285 |
| 8,298,998 | B2 | 10/2012 | Creasey | |
| 9,291,018 | B2 | 3/2016 | Korn, Jr. et al. | |
| 2010/0155054 | A1 * | 6/2010 | Innes | E21B 27/02 166/165 |
| 2017/0226400 | A1 | 8/2017 | Amanullah | |
| 2017/0226814 | A1 | 8/2017 | Clemens et al. | |

* cited by examiner

METHOD AND APPARATUS FOR STUCK PIPE MITIGATION

BACKGROUND OF THE DISCLOSURE

1. Field of the Disclosure

The disclosure relates generally to hydrocarbon development operations in a subterranean well, and more particularly to moving tubular members within a subterranean well during hydrocarbon development operations.

2. Description of the Related Art

A stuck pipe within a subterranean well is a cause of lost time during drilling and completion operations, especially in deviated and horizontal wells. Problems resulting from a stuck pipe can range from incidents causing an increase in costs, to incidents where it takes days to get the pipe unstuck. In extreme cases where the problem cannot be resolved, the bore may have to be plugged and abandoned. In addition, contact between the tubular string and the inner surface of the subterranean well even before the pipe becomes stuck can cause wear and damage to the tubular string.

Wear and damage to the tubular string can also be caused by cutting accumulations in the subterranean well from drilling operations. Such cuttings can accumulate, in particular, at a lower side of a deviated bore. The cuttings can reduce the velocity of fluid flow in the annulus between the tubular string and the inner surface of the subterranean well and can also be a cause of the tubular string sticking and being unable to proceed further into the subterranean well. The tubular string can be, for example, a drill string that is lowered into the subterranean well.

SUMMARY OF THE DISCLOSURE

Systems and methods of this disclosure provide a collar tool assembly that can be used to mitigate the risk of a stuck pipe or free an already stuck pipe. The collar tool assembly has a hollow interior cavity for storing well treatment fluid. A hydraulic system of the collar tool assembly can be remotely activated to inject the treatment fluid into the well bore. Collar tool assembly is a smart tool and the hydraulic system can be activated and deactivated remotely as desired by the operator. The collar tool assembly can be part of a bottom hole assembly of a drilling string and can be a drilling collar.

In some stuck pipe situations, circulations through the tubular string is not possible. Embodiments of this disclosure provide a localized downhole supply of treatment fluid to allow for the delivery of treatment fluid to the location within the wellbore required to release a stuck pipe when circulation through the tubular string is not possible.

In an embodiment of this disclosure a system for moving a tubular string within a subterranean well includes a collar tool assembly having a tubular body, the tubular body being an elongated member with a central axis. An inner bore extends axially through the tubular body. The inner bore of the tubular body is positioned to be in fluid communication with an inner bore of the tubular string when the tubular body is connected in line with joints of the tubular string. An outer cavity located radially outward of the inner bore. An injection port assembly extends from the outer cavity to an outer diameter surface of the tubular body. The injection port assembly is operable to move between an injection port closed position and an injection port open position. The system for moving a tubular string within a subterranean well further includes a hydraulic system, the hydraulic system operable to force a treatment fluid of the outer cavity out of the tubular body when the injection port assembly is in the injection port open position. An injection port programmable logic controller is in signal communication with the hydraulic system and is operable to command the injection port assembly to move between the injection port closed position and the injection port open position.

In alternate embodiments, the outer cavity can have an annular cross section and can circumscribe the inner bore. The outer cavity can include a plurality of separate elongated open spaces within the tubular body. The tubular string can be a drilling string and the collar tool assembly can be part of a bottom hole assembly. The treatment fluid can be an acid.

In other alternate embodiments, the hydraulic system can include a displacing plate that seals around an inner diameter surface of the outer cavity, the displacing plate can be movable axially within the outer cavity and can be operable to force the treatment fluid out of the outer cavity. An outer diameter of the tubular body can be larger than an outer diameter of the tubular string. The tubular body can have an uphole connector and a downhole connector, the uphole connector and the downhole connector shaped to connect the tubular body in line with the joints of the tubular string.

In an alternate embodiment of this disclosure, a system for moving a tubular string within a subterranean includes the tubular string with a central axis extending into a bore of the subterranean well. A collar tool assembly is connected in line with the tubular string. The collar tool assembly includes a tubular body, the tubular body being an elongated member. An inner bore extends axially through the tubular body, the inner bore in fluid communication with an inner bore of the tubular string. An outer cavity is located radially outward of the inner bore. An injection port assembly extends from the outer cavity to an outer diameter surface of the tubular body. The injection port assembly is operable to move between an injection port closed position and an injection port open position. When the injection port assembly is in the injection port open position the outer cavity is in fluid communication with the bore of the subterranean well. A hydraulic system is operable to force a treatment fluid of the outer cavity into the bore of the subterranean well when the injection port assembly is in the injection port open position. An injection port programmable logic controller is in signal communication with the hydraulic system and is operable to command the injection port assembly to move between the injection port closed position and the injection port open position.

In alternate embodiments, the tubular string can be a drilling string and the collar tool assembly can be part of a bottom hole assembly. The hydraulic system can include a displacing plate that seals around an inner diameter surface of the outer cavity. The displacing plate can be movable axially within the outer cavity and can operable to force the treatment fluid into the bore of the subterranean well.

In yet another alternate embodiment of this disclosure, a method for moving a tubular string within a subterranean well includes providing a collar tool assembly. The collar tool assembly has a tubular body. The tubular body is an elongated member with a central axis. An inner bore extends axially through the tubular body. The inner bore is positioned to be in fluid communication with an inner bore of the tubular string when the tubular body is connected in line with joints of the tubular string. An outer cavity is located radially outward of the inner bore. An injection port assembly extends from the outer cavity to an outer diameter surface of the tubular body. The injection port assembly is operable to move between an injection port closed position and an injection port open position. A hydraulic system is operable to force a treatment fluid of the outer cavity out of the tubular body when the injection port assembly is in the injection port open position. An injection port programmable logic controller is in signal communication with the hydraulic system and operable to command the injection port assembly to move between the injection port closed position and the injection port open position. The method further includes connecting the collar tool assembly in line with the joints of the tubular string and lowering the tubular string into the subterranean well.

In alternate embodiments the tubular string can be a drilling string and the collar tool assembly is part of a bottom hole assembly. The treatment fluid can be an acid. The method can further include forcing the treatment fluid out of the outer cavity and into the subterranean well by axial movement of a displacing plate, the displacing plate sealing around an inner diameter surface of the outer cavity. The tubular body can have an uphole connector and a downhole connector. Connecting the collar tool assembly in line with the joints of the tubular string can include connecting the uphole connector to an uphole joint and connecting the downhole connector to a downhole joint.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
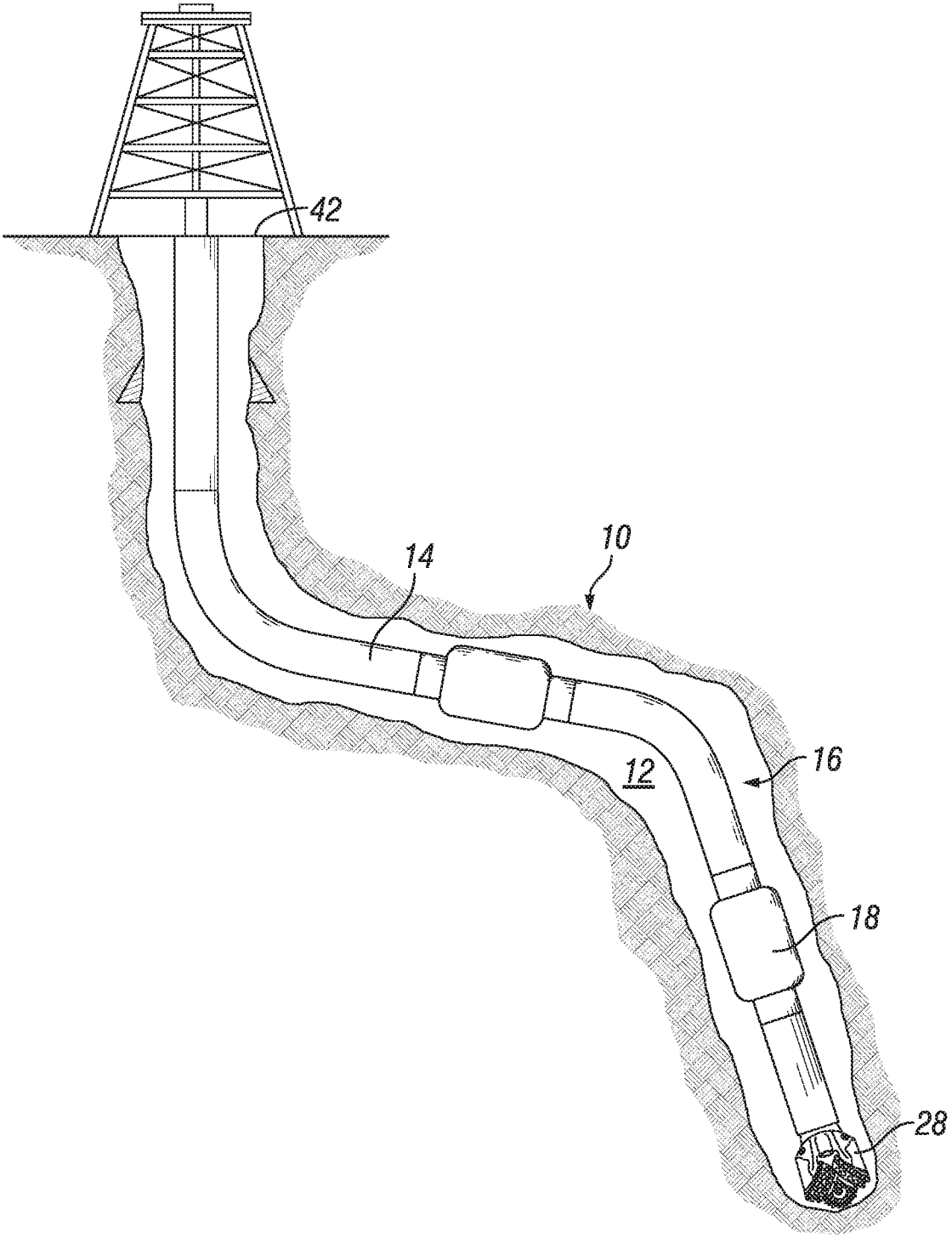
FIG. 1 is a schematic sectional representation of a subterranean well having a collar tool assembly, in accordance with an embodiment of this disclosure.

Looking at FIG. 1, subterranean well 10 extends downwards from a surface of the earth, which can be a ground level surface or a subsea surface. Bore 12 of subterranean well 10 can extended generally vertically relative to the surface. Bore 12 can alternately include portions that extend generally horizontally or in other directions that deviate from generally vertically from the surface. Subterranean well 10 can be a well associated with hydrocarbon development operations, such as a hydrocarbon production well, an injection well, or a water well.

Tubular string 14 extends into bore 12 of subterranean well 10. Tubular string 14 can be, for example, a drill string, a casing string, or another elongated member lowered into the subterranean well. In the example of FIG. 1, tubular string 14 is a drilling string with bottom hole assembly 16.

As tubular string 14 moves through bore 12, there may be times when tubular string 14 is at risk of becoming stuck, or does become stuck. The risk of becoming stuck increases, for example, in bores with an uneven inner surface or bores that have a change in direction. In bores that pass through formations that have a risk of collapsing, cleaning the bore can be a challenge and there is also an increased risk of a pipe sticking. Exploration wells, such as wildcat wells can have uncertain profiles and are also at increased risk for pipe sticking incidents.

A system for moving tubular string 14 within subterranean well 10 can include collar tool assembly 18. In the example embodiment of FIG. 1, two collar tool assemblies 18 are shown. In alternate embodiments, there can be one collar tool assembly 18 or there can be more than two collar tool assemblies 18. Collar tool assemblies 18 can be located along tubular string 14 at positions that are predicted to be at risk for becoming stuck or otherwise could benefit from receiving a treatment fluid. In the example embodiment of FIG. 1, collar tool assemblies 18 are part of bottom hole assembly 16. Collar tool assemblies 18

Figure 2:
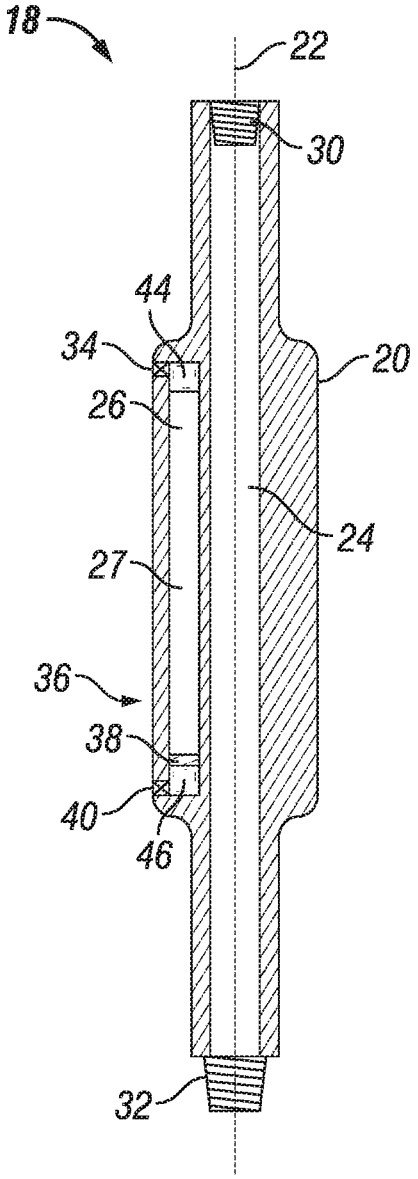
FIG. 2 is a section view of the collar tool assembly, in accordance with an embodiment of this disclosure, shown with the injection port assembly in the injection port open position.

Looking at FIG. 2, collar tool assembly 18 has tubular body 20. Tubular body 20 is an elongated member with central axis 22. Tubular body 20 can be formed of an acid resistant alloy such as, for example, Inconel® (a registered mark of Special Metals Corporation. Inner bore 24 extends axially through tubular body 20. Inner bore 24 is positioned to be in fluid communication with an inner bore of tubular string 14 when tubular body 20 is connected in line with joints of tubular string 14.

Collar tool assembly 18 further includes outer cavity 26 located radially outward of inner bore 24. Outer cavity 26 is an open space within tubular body 20 that can contain a treatment fluid 27 for delivery into bore 12. In certain embodiments treatment fluid 27 can be an acid. The concentration of the acid used can be selected based on the expected conditions within bore 12. As an example, the acid can be hydrochloric acid or floric acid and can have a concentration of 15-30 percent (measured as mass percentage). In general, the higher the concentration of the acid the more efficient treatment fluid 27 will be in preventing or freeing a stuck pipe. In alternate embodiments, treatment fluid 27 can instead be a lubricant such as diesel or a lighter oil.

Outer cavity 26 can have an annular cross section and circumscribe inner bore 24. Alternately, outer cavity 26 can include a plurality of separate elongated open spaces within tubular body 20 radially outward of inner bore 24.

Tubular body 20 can have an outer diameter that is larger than an outer diameter of tubular string 14. Tubular body 20 can have dimensions that are similar to a standard drill collar. As an example, for a 6 inch bore, tubular body 20 can have a diameter of 4.75 inches, for a 8.5 inch bore, tubular body 20 can have a 7 inch diameter and for a bore that is 12.25 inches or greater, tubular body 20 can have a diameter that is 8 or 9 inches. Tubular body 20 can be sized and weighted to assist with drilling operations. For example, tubular body 20 can increase the stiffness and weight of bottom hole assembly 16 so that bottom hole assembly can drill a deeper bore 12 or can drill through harder or more abrasive formations compared to a less stiff or lighter bottom hole assembly. The weight of tubular body 20 can act on drill bit 28 (FIG. 1) and assist in maintaining a stable drilling operation.

Tubular body 20 of collar tool assembly 18 can have uphole connector 30 and downhole connector 32. Uphole connector 30 and downhole connector 32 are shaped to connect tubular body 20 in line with the joints of tubular string 14. Uphole connector 30 can be connected to an uphole joint of tubular string 14 and downhole connector 32 can be connected to a downhole joint of tubular string 14. In the example of FIG. 2, uphole connector 30 and downhole connector 32 are shown as threaded connection members. In alternate embodiments uphole connector 30 and downhole connector 32 can be other types of tubular connectors known in the industry, such as a flange and bolt connector, a ratchet style connector, or a slips type connector.

Figure 3:
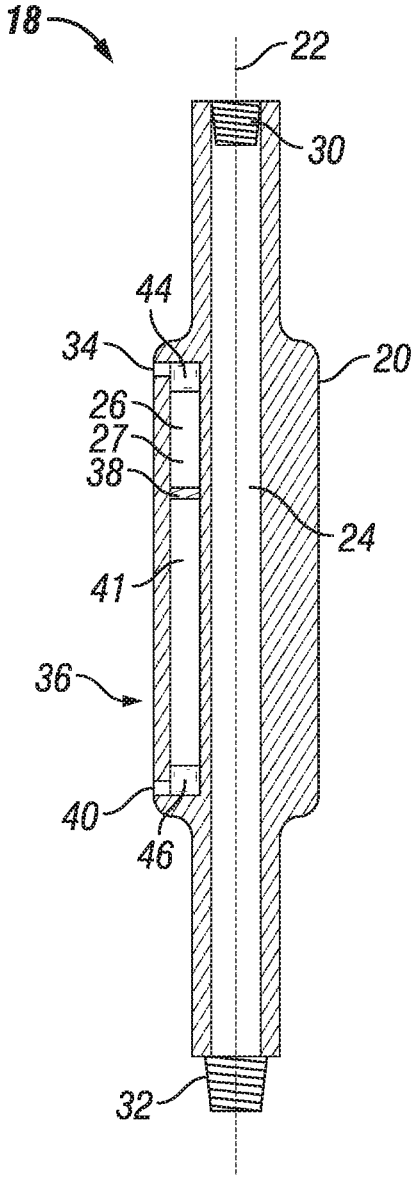
FIG. 3 is a section view of the collar tool assembly, in accordance with an embodiment of this disclosure, shown with the injection port assembly in the injection port closed position.

Tubular body 20 further includes injection port assembly 34. Injection port assembly 34 extends from outer cavity 26 to an outer diameter surface of tubular body 20. Injection port assembly 34 is operable to move between an injection port closed position (FIG. 2) and an injection port open position (FIG. 3). When injection port assembly 34 is in the injection port open position outer cavity 26 is in fluid communication with bore 12 of subterranean well 10.

Collar tool assembly 18 further includes hydraulic system 36. Hydraulic system 36 can force a treatment fluid of outer cavity 26 out of tubular body 20 when injection port assembly 34 is in the injection port open position. In the example of FIG. 1, hydraulic system 36 includes displacing plate 38 that seals around an inner diameter surface of outer cavity 26. Displacing plate 38 is movable axially within outer cavity 26 and is operable to force treatment fluid 27 out of outer cavity 26. When injection port assembly 34 is in the injection port open position, hydraulic system 36 can push treatment fluid out of outer cavity 26, through injection port assembly and into bore 12.

Collar tool assembly 18 can further include pressure port 40. Pressure port 40 is moveable between a pressure port closed position (FIG. 2) and a pressure port open position (FIG. 3). In order to push treatment fluid out of outer cavity 26, pressure fluid 41 can be pumped into pressure port 40. Pressure fluid 41 can have sufficient pressure to move displacing plate 38. Pressure fluid 41 can be a wellbore fluid or can be a separate hydraulic fluid that can be either stored locally within tubular body 20, or be pumped from the surface 42 (FIG. 1). In alternate embodiments, treatment fluid 27 can be stored in outer cavity 26 at pressure so that when injection port assembly 34 is in the injection port open position, treatment fluid 27 will flow freely out of outer cavity 26 and into bore 12. In such an embodiment, the flow of treatment fluid 27 out of outer cavity 26 will draw displacing plate 38 towards injection port assembly. The movement of displacing plate 38 will draw wellbore fluid into outer cavity 26 through pressure port 40.

Injection port programmable logic controller 44 is in signal communication with injection port assembly 34. Injection port programmable logic controller 44 can command injection port assembly 34 to move between the injection port closed position and the injection port open position. Injection port programmable logic controller 44 can be monitored and controlled from a location at surface 42, such as at a local or remote office location. As an example, injection port programmable logic controller 44 can be controlled by mud pulses signaled at the rig floor or at a remote office.

Pressure port programmable logic controller 46 is in signal communication with pressure port 40. Pressure port programmable logic controller 46 can command pressure port 40 to move between the pressure port closed position and the pressure port open position. Pressure port programmable logic controller 46 can be monitored and controlled from a location at surface 42, such as at a local or remote office location. As an example, pressure port programmable logic controller 46 can be controlled by mud pulses signaled at the rig floor or at a remote office.

In an example of operation, in order to move tubular string 14 within subterranean well 10, one or more collar tool assemblies 18 can be connected in line with joints of tubular string 14. Collar tool assembly 18 is connected in a way that allows inner bore 24 of collar tool assembly 18 to align with a bore of the joints of tubular string 14 so that fluids, such as drilling fluid, mud, or production fluid can be delivered to a downhole end of tubular string 14 from surface 42.

The number and size of collar tool assembly 18 can be selected to optimize the movement of tubular string 14 within subterranean well 10 and improve the performance of tubular string 14. As an example, when tubular string 14 is a drilling string the number and size of collar tool assembly 18 can be selected to store a sufficient amount of treatment fluid to cover a sufficient expected problematic region within bore 12 to minimize the chances of tubular string 14 being stuck within bore 12 and to maximize the probability of tubular string 14 of getting freed if tubular string 14 does become stuck. In addition, the number and size of collar tool assembly 18 can be selected to provide a desired level of weight and stiffness to bottom hole assembly 16 to improve the drilling operation.

The location of each collar tool assembly 18 along the length of tubular string 14 can be selected so that such collar tool assembly 18 is located at an expected location within bore 12 that may lead to a pipe sticking situation. For example, a collar tool assembly 18 can be positioned along the length or tubular string 14 so that such collar tool assembly is in the vicinity of a sticking point of tubular string 14 as tubular string 14 passes through a bend of bore 12.

After the joints of tubular string 14 are made up with collar tool assembly 18, tubular string 14 is lowered into subterranean well 10. When an operator determines that tubular string 14 is at risk of being stuck or when tubular string 14 does become stuck then treatment fluid 27 within one or more collar tool assembly 8 can be injected into bore 12.

In order to force treatment fluid 27 out of outer cavity 26 and into subterranean well 10, a signal can be remotely sent to injection port programmable logic controller 44 to command injection port assembly 34 to move from the injection port closed position and the injection port open position. A signal can also be remotely sent to pressure port programmable logic controller 46 to command pressure port 40 to move from the pressure port closed position and the pressure port open position.

Positioning injection port assembly 34 in the injection port open position and positioning pressure port 40 in the pressure port open position will cause axial movement of displacing plate 38 to push treatment fluid 27 out of outer cavity 26. In certain embodiments, treatment fluid 27 includes a concentrated acid that can oxidize a mud cake or otherwise react with a downhole formation to mitigate or release a stuck pipe situation. Treatment fluid can also be formulated to lubricate or can be formulated to generate a gas to increase buoyancy of the mud or other wellbore fluid.

In current hydrocarbon development operations, a plan to free a stuck pipe can include jarring the stuck pipe, attempting to back off the stick pipe, performing a fishing operation or spotting a treatment pill. The treatment pill can include a lubricant, an acid, a hydrostatic reduction treatment, or a general filter cake degradation treatment. It is noted that the sooner the treatment fluid is provided, the better the chance of freeing a stuck pipe. Embodiments of this disclosure include collar tool assembly 18 that can provide a treatment fluid very quickly, even if a pill cannot be delivered from the surface.

Embodiments of this disclosure can therefore provide a solution for mitigating a stuck pipe that can provide a treatment locally at the desired interval instead of being pumped from the surface. This will allow for a quicker delivery of the treatment fluid to the desired site than if the treatment fluid was pumped from the surface. This will allow for a quicker freeing of the stuck pipe as well as increasing the probability that the pipe will be successfully freed. Embodiments of this disclosure can also be used to clean a wellbore before a stuck pipe situation occurs.

Systems of this disclosure can also provide additional weight on the bit to act as a stabilizer and can also resist corrosion and retain mechanical strength by being formed of an acid resistant alloy.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for moving a tubular string within a subterranean well, the system having:

a collar tool assembly including:

a tubular body, the tubular body being an elongated member with a central axis;

an inner bore extending axially through the tubular body, the inner bore of the tubular body positioned to be in fluid communication with an inner bore of the tubular string when the tubular body is connected in line with joints of the tubular string;

and an outer cavity located radially outward of the inner bore;

an injection port assembly extending from the outer cavity to an outer diameter surface of the tubular body, the injection port assembly operable to move between an injection port closed position and an injection port open position;

a hydraulic system, the hydraulic system operable to force a treatment fluid of the outer cavity out of the tubular body when the injection port assembly is in the injection port open position; and an injection port programmable logic controller in signal communication with the hydraulic system and operable to command the injection port assembly to move between the injection port closed position and the injection port open position.

2. The system of claim 1 where the outer cavity has an annular cross section and circumscribes the inner bore.

3. The system of claim 1, where the outer cavity includes a plurality of separate elongated open spaces within the tubular body.

4. The system of claim 1, where the tubular string is a drilling string and the collar tool assembly is part of a bottom hole assembly.

5. The system of claim 1, where the treatment fluid is an acid.

6. The system of claim 1, where the hydraulic system includes a displacing plate that seals around an inner diameter surface of the outer cavity, the displacing plate movable axially within the outer cavity and operable to force the treatment fluid out of the outer cavity.

7. The system of claim 1, where an outer diameter of the tubular body is larger than an outer diameter of the tubular string.

8. The system of claim 1, where the tubular body has an uphole connector and a downhole connector, the uphole connector and the downhole connector shaped to connect the tubular body in line with the joints of the tubular string.

9. A system for moving a tubular string within a subterranean well, the system having:

the tubular string with a central axis extending into a bore of the subterranean well;

a collar tool assembly connected in line with the tubular string, the collar tool assembly including:

a tubular body, the tubular body being an elongated member;

an inner bore extending axially through the tubular body, the inner bore of the tubular body in fluid communication with an inner bore of the tubular string;

and an outer cavity located radially outward of the inner bore;

an injection port assembly extending from the outer cavity to an outer diameter surface of the tubular body, the injection port assembly operable to move between an injection port closed position and an injection port open position, where when the injection port assembly is in the injection port open position the outer cavity is in fluid communication with the bore of the subterranean well;

a hydraulic system, the hydraulic system operable to force a treatment fluid of the outer cavity into the bore of the subterranean well when the injection port assembly is in the injection port open position; and an injection port programmable logic controller in signal communication with the hydraulic system and operable to command the injection port assembly to move between the injection port closed position and the injection port open position.

10. The system of claim 9, where the tubular string is a drilling string and the collar tool assembly is part of a bottom hole assembly.

11. The system of claim 9, where the hydraulic system includes a displacing plate that seals around an inner diameter surface of the outer cavity, the displacing plate movable axially within the outer cavity and operable to force the treatment fluid into the bore of the subterranean well.

12. A method for moving a tubular string within a subterranean well, the method including:

providing a collar tool assembly including:

a tubular body, the tubular body being an elongated member with a central axis;

an inner bore extending axially through the tubular body, the inner bore of the tubular body positioned to be in fluid communication with an inner bore of the tubular string when the tubular body is connected in line with joints of the tubular string;

an outer cavity located radially outward of the inner bore;

an injection port assembly extending from the outer cavity to an outer diameter surface of the tubular body, the injection port assembly operable to move between an injection port closed position and an injection port open position;

a hydraulic system, the hydraulic system operable to force a treatment fluid of the outer cavity out of the tubular body when the injection port assembly is in the injection port open position; and an injection port programmable logic controller in signal communication with the hydraulic system and operable to command the injection port assembly to move between the injection port closed position and the injection port open position;

connecting the collar tool assembly in line with the joints of the tubular string; and lowering the tubular string into the subterranean well.

13. The method of claim 12, where the tubular string is a drilling string and the collar tool assembly is part of a bottom hole assembly.

14. The method of claim 12, where the treatment fluid is an acid.

15. The method of claim 12, further including forcing the treatment fluid out of the outer cavity and into the subterranean well by axial movement of a displacing plate, the displacing plate sealing around an inner diameter surface of the outer cavity.

16. The method of claim 12, where the tubular body has an uphole connector and a downhole connector, and connecting the collar tool assembly in line with the joints of the tubular string includes connecting the uphole connector to an uphole joint and connecting the downhole connector to a downhole joint.

* * * * *